US005713553A

United States Patent [19]

Cooper

[11] Patent Number: 5,713,553

[45] Date of Patent: Feb. 3, 1998

[54] PORTABLE STAND

[76] Inventor: Martin F. Cooper, 549 8th Street East, Owen Sound, Ontario, Canada, N4K 1L7

[21] Appl. No.: 707,849

[22] Filed: Sep. 6, 1996

[51] Int. Cl.[6] ..... A47B 97/08

[52] U.S. Cl. ..... 248/461; 248/170; 248/188.6; 248/188.7; 248/464

[58] Field of Search ..... 248/460, 461, 248/188.7, 170, 188.6, 165, 463, 464; 135/127; 403/291, 169, 170

[56] References Cited

U.S. PATENT DOCUMENTS

| | | | |
|---|---|---|---|
| 2,237,202 | 4/1941 | Strattan | 248/170 X |
| 2,481,264 | 9/1949 | Tulowiecki | 248/461 |
| 3,834,410 | 9/1974 | Leibel | 135/127 X |
| 4,149,763 | 4/1979 | Delahaie | 248/461 X |
| 4,606,525 | 8/1986 | Lombardi | 248/460 |
| 4,671,479 | 6/1987 | Johnson et al. | 248/188.7 X |
| 4,846,205 | 7/1989 | Knoll | 403/291 X |
| 5,037,057 | 8/1991 | Andrews | 248/460 |
| 5,337,996 | 8/1994 | Kalish | 248/461 X |
| 5,423,341 | 6/1995 | Brady | 135/127 X |
| 5,582,197 | 12/1996 | Dobberstein | 135/127 X |

*Primary Examiner*—Michael Safavi

[57] ABSTRACT

In a combination stand and rack releasably secured atop the stand, the stand is convertible between an extended use position and a collapsed storage position. The rack includes a hollow spine for storage of the stand in the collapsed storage position. The stand comprises a main telescopic post and a plurality of support legs all of which are secured to a common housing. The main post extends upwardly from the housing and the legs are attached to the housing by connectors which are bendable through an angle of more than 90° such that the legs fold upwardly beside the main post in the storage position and unfold downwardly from the housing to the use position.

8 Claims, 6 Drawing Sheets

FIG. 6.
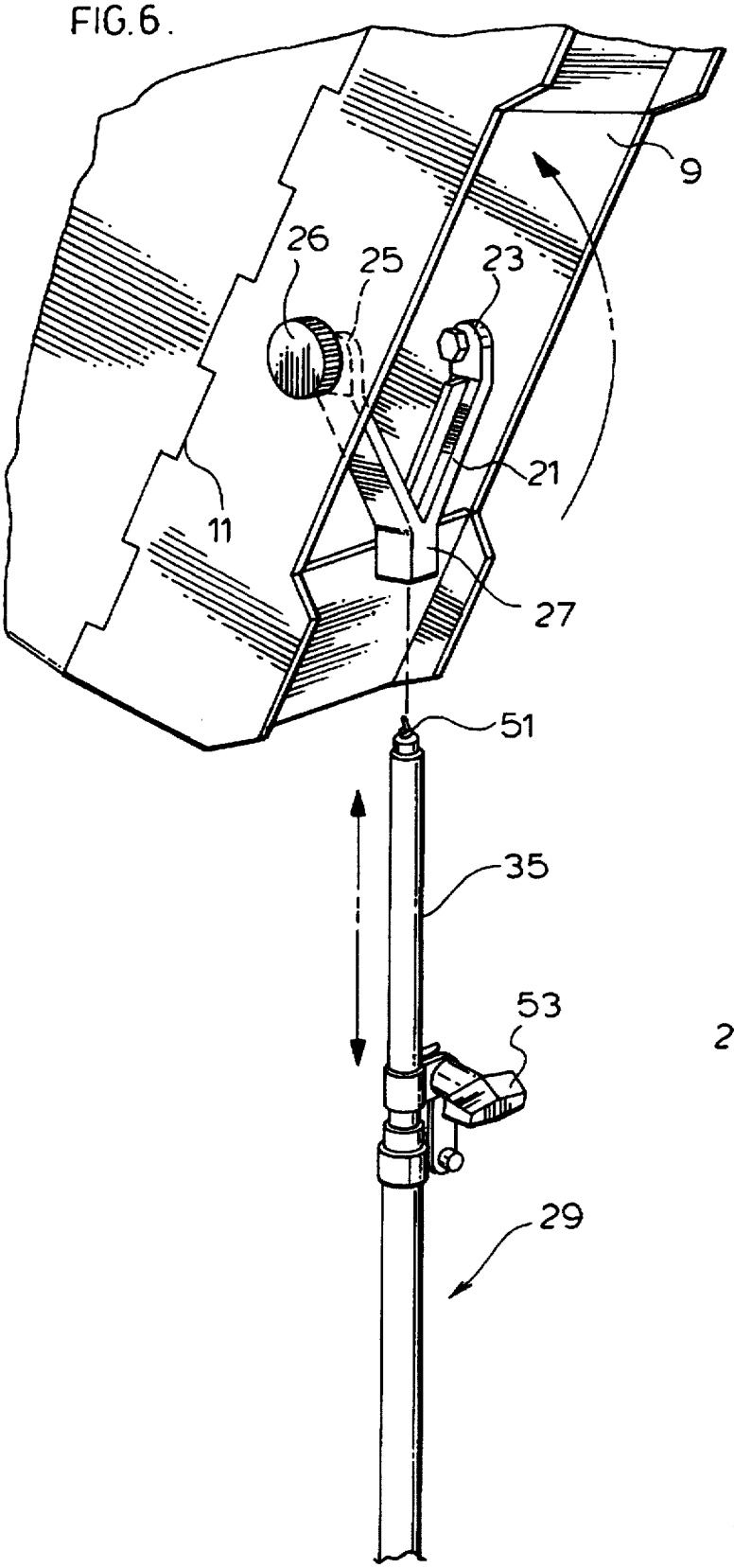
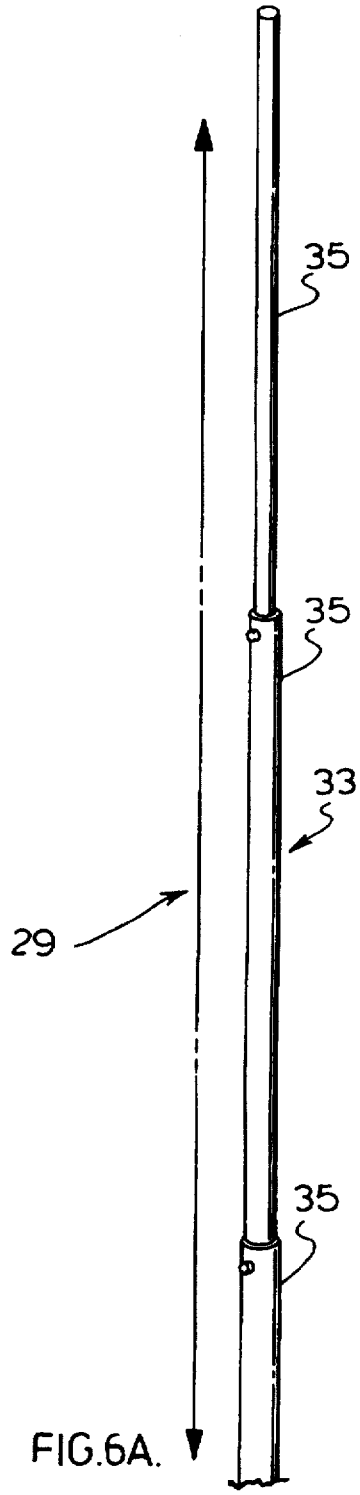
FIG. 6A.

PORTABLE STAND

FIELD OF THE INVENTION

The present invention relates to a combination stand and book-like rack releasably secured to one another.

BACKGROUND OF THE INVENTION

Portable rack and stand combinations have been made available in the past. Many of these prior art combinations include collapsible stands which store within the rack when the rack is closed. In most of the prior art combinations, the rack and the stand are dedicated to one another, i.e. they are permanently attached so that they cannot be used independently as is the case with the rack and stand combination found in U.S. Pat. No. 2,481,264 issued Sep. 6, 1949 to Tulowiecki.

U.S. Pat. No. 3,031,247 issued Apr. 24, 1962 to Schieve shows a portable combination lectern and easel. In this particular structure, the stand is completely removable from the easel for storage purpose. But in order to collapse the legs of the stand, they must be separated from one another and each of the legs in turn breaks down into a plurality of individual and separate leg segments. This not only makes assembly of the stand difficult, but in addition, produces the risk that some of the leg pieces can easily be lost.

SUMMARY OF THE INVENTION

The present invention provides a combination stand and rack releasably secured to one another. The stand itself is convertible between an extended use and a collapsed storage position and the rack has a hollow spine for storage of the stand in the collapsed storage position.

The stand itself is unique in that it comprises a main telescopic post and a plurality of base legs all of which are secured to a common housing. The main post extends upwardly from the housing and the legs are attached to the housing by connectors which are bendable through an angle of more than 90° such that the legs fold upwardly beside the main post in the storage position and then unfold downwardly from the housing to the use position.

In accordance with the present invention, both the rack and the stand are usable independently of one another and through the use of novel connectors which are preferably in the form of stretch cords all parts of the stand remain permanently secured to one another in both a use and a storage position.

BRIEF DESCRIPTION OF THE DRAWINGS

The above as well as other advantages and features of the present invention will be described in greater detail according to the preferred embodiments of the present invention in which;

FIG. 6 is an enlarged perspective view of the attachment between the rack and the main post of the stand;

FIG. 6*a* is a perspective view showing the telescopic action of the main post of the stand;

DETAILED DESCRIPTION ACCORDING TO THE PREFERRED EMBODIMENTS OF THE PRESENT INVENTION

Figure 1:
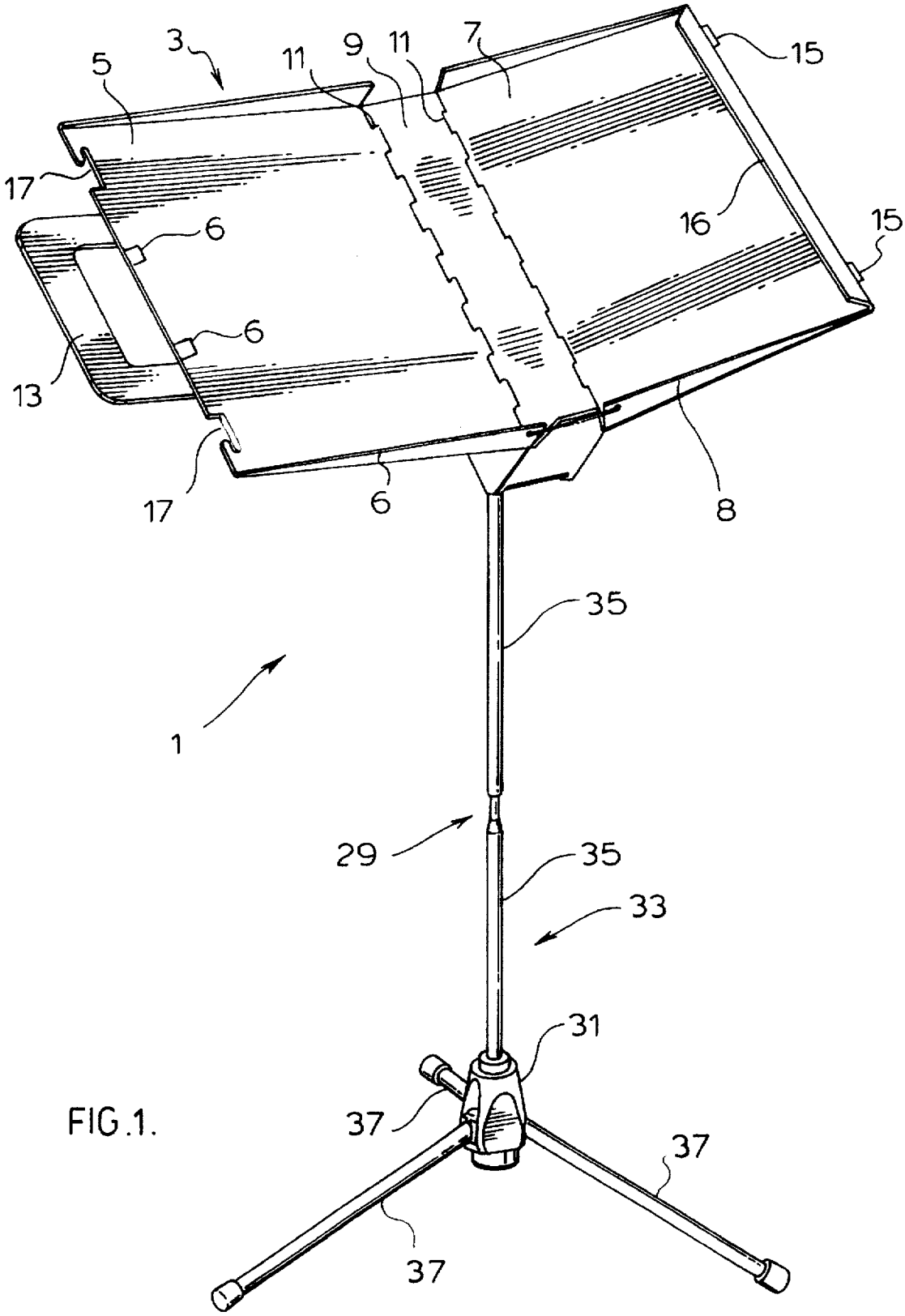
FIG. 1 is a perspective view of a combination rack and stand in the use position according to a preferred embodiment of the present invention.

FIG. 1 shows a combination stand and rack generally indicated at 1. The two are separable and usable independently of one another as will be described later in greater detail.

FIG. 1 shows the combination stand and rack in its use position with the rack 3 being opened and usable for different purposes such as a book stand or a music stand. It is then foldable to the FIG. 2 transport condition where different papers and the like can be stored within the rack. The rack is formed by opposite side members 5 and 7 foldable at hinges 11 relative to a central spine 9. Each of the side members may be provided with clips, such as clip 6, holding the interior contents in place during the folding and unfolding of the rack.

The spine 9 has a hollow construction which allows for storage of the stand when the rack and stand are separated from one another and when the stand is collapsed.

Figure 2:
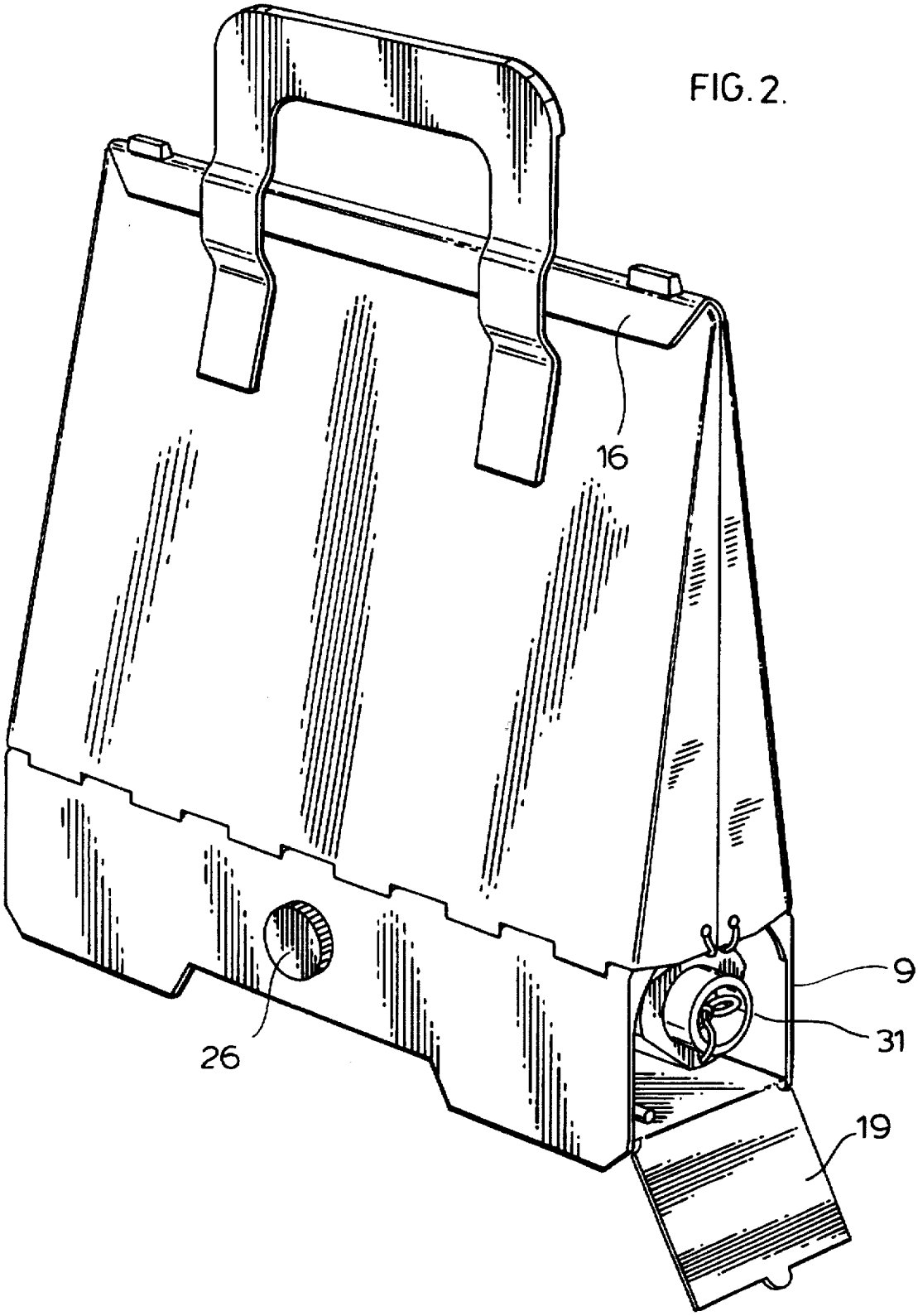
FIG. 2 shows the combination of FIG. 1 when in the storage position.

The side member 7 of rack 3 is provided with a pair of lock members 15 which lock into openings 17 of the other side member 5 when the two side members are closed against one another as shown in FIG. 2. A top lip 16 on side member 7 additionally wraps around the outer edge of side member 5. A single handle 13 is provided for carrying the rack with the stand held in the spine of the rack.

As earlier described, the spine of the rack is hollow and is closed at the end which faces downwardly when the rack is in the use position. The other or upper end of the spine is opened for storing of the collapsed stand which is provided with some means of securing the stand within the spine. In the embodiment shown, this means is in the form of a small snap lock door 19, best seen in FIG. 2 of the drawings. Other means such as spring detentes and the like can also be used to hold the collapsed stand within the hollow spine of the rack. In addition, pens and pencils and the like can be stored within the rack which may be provided with a closed pocket to contain these articles.

An attachment piece for the stand in the form of a yoke 21 is provided on the base or underside of the spine. This yoke is attached to the spine by a pair of pivotal connections 23 and 25. The connection 25 includes a manually adjustable tightening knob 26 which allows the yoke to be held in various different positions relative to the spine. Note that the underside of the spine is recessed so that the yoke can be moved to its storage position effectively hidden by the spine.

Yoke 21 includes a hollow collar 27 which releasably attaches to the upper end of the stand which is generally indicated at 29 and which is better described immediately below.

Stand 29 which is a very key feature of the present invention comprises a main post 33, a plurality support leg 37 and a housing 31 to which both the main post and all of the support legs are connected. The connection of the housing to the main post and support legs is permanent in the sense that they all remain assembled with one another in both the use and the storage position.

The main post 33 extends upwardly from the top side of housing 31 and is formed by a plurality of post sections 35 which telescope relative to one another to either extend upwardly to the use position or to collapse downwardly to the storage position. The telescopic post sections are all approximately of the same length and slightly shorter than the support legs 37.

Figure 3:
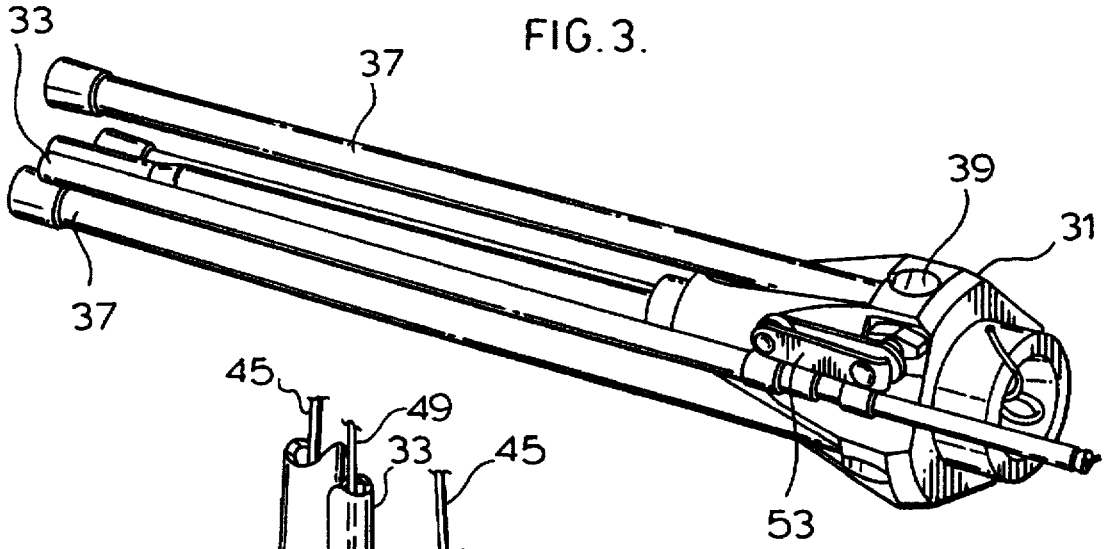
FIG. 3 shows the stand of the combination of FIG. 1 in the storage position.
Figure 7:
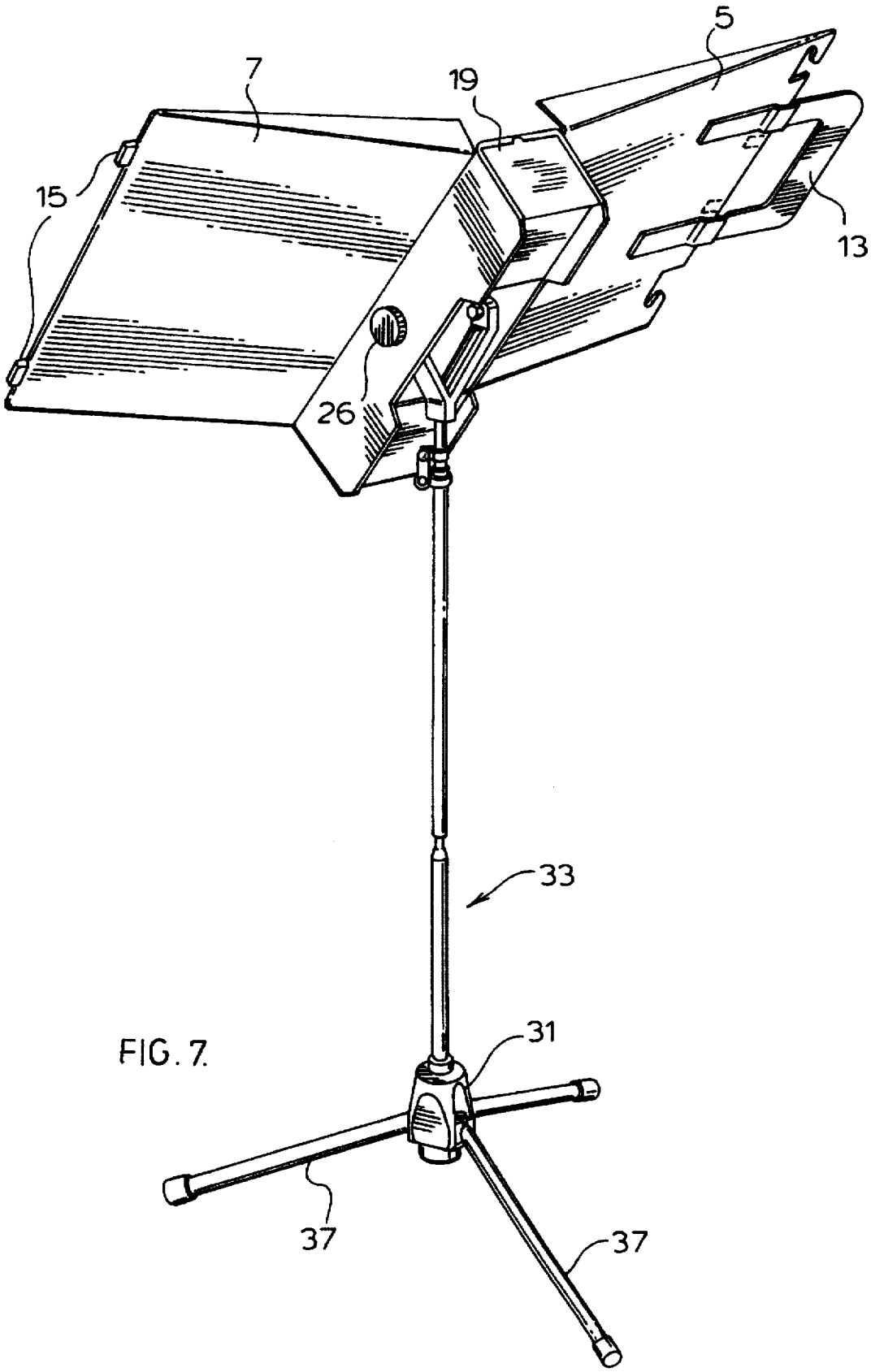
FIG. 7 is a rear perspective view of a combination rack and stand of FIG. 1.

As will be seen in FIG. 1 of the drawings, the support legs, when in a use position, extend downwardly outwardly from housing 31. When in the storage position, the support legs fold upwardly of the housing and lie substantially parallel to and slightly outside of the collapsed main post 33 as shown in FIG. 3 of the drawings. The support legs move from the use to the storage position while remaining connected to the housing through the use of a novel connection method between the legs and the housing. This connection allows the support legs to hinge relative to housing 31 through an angle of more than 90° from their downward outward positioning of FIGS. 1 and 7 to the storage position of FIG. 3.

More particularly, the support legs 37 are connected to housing 31 by means of stretch cords 45. Each of the legs contains one of these stretch cords. Each of the stretch cords passes through the open inner end of its respective leg and is secured at one of its ends to the bottom end 47 of housing 31. The other end of the stretch cord is secured at the other or outer end of leg 37 as indicated at 38 in FIG. 5 of the drawings.

Figure 4:
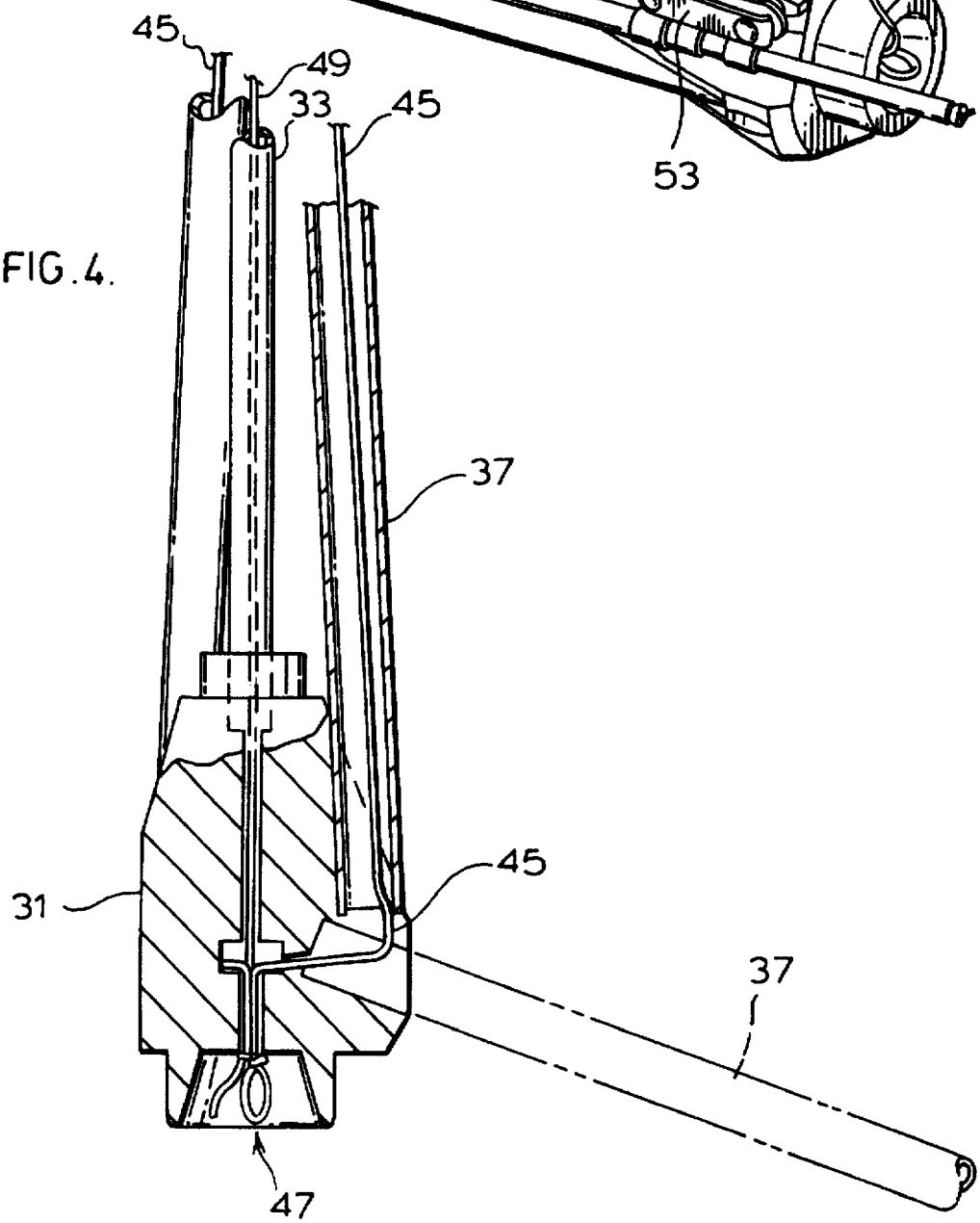
FIG. 4 is a sectional view of the stand showing movement of one of its legs from the storage to the use position.

Housing 31 includes a first opening 39 at the inner end of each of leg 37. Opening 39 is sized to receive the inner end of the leg and hold it in its downward outward use positioning as shown by the dotted lines in the lower right hand portion of FIG. 4 of the drawings. Stretch cord 45 is always under tension and therefore pulls leg 37 into opening 39 which holds the use positioning of the leg.

Housing 31 also includes a further opening 41 facing upwardly at the inner end of each of the legs 37. Opening 41 lies at the base of a recess 43 rising vertically upwardly along the side wall of housing 31. A slot 40 extends between opening 39 and 41.

The same arrangement of openings 39 and 41 with slot 40 between the openings and a recess 43 is provided for each of the support legs.

In order to move any one of the support legs 37 from the use to the storage position, the inner end of the leg 37 is pulled out of its appropriate locking hole 39 against the tension in stretch cord 45. The leg is then repositioned such that its inner end aligns with opening 41 where the tension in the cord pulls the inner end of the leg downwardly into that particular opening. The leg is now held in its storage position guided in its fitting outside of and parallel to the main post 33 by the recess 43. Slot 40 allows the stretch cord to move between the two recesses 39 and 41.

Figure 5:
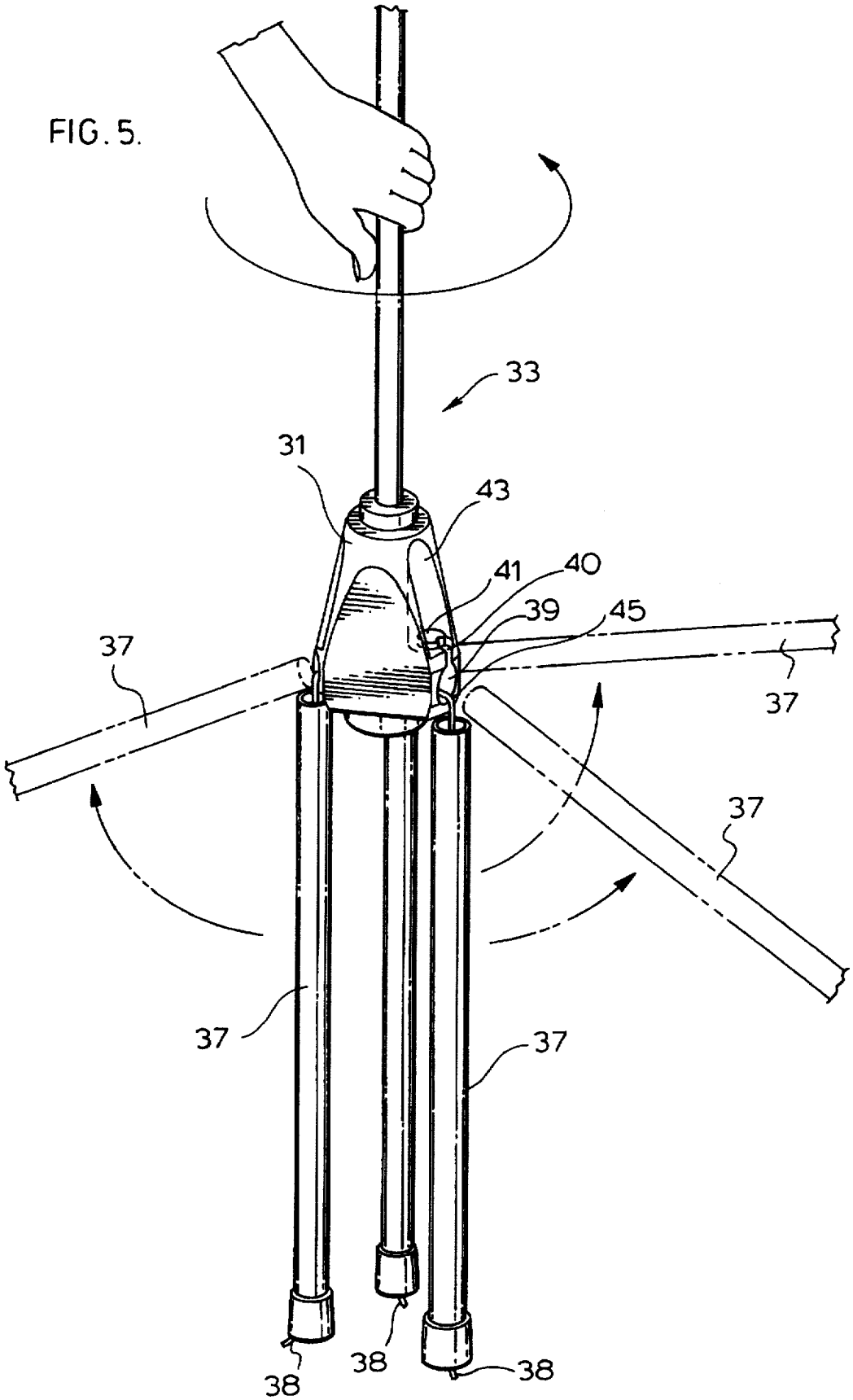
FIG. 5 is a perspective view of the stand showing a hand operation for moving the legs to the use position.

The resetting of the support legs from the storage to the use position is by a simple reversal of the above steps. This can very easily be accomplished, i.e. the resetting of the legs in the use position, by pulling them out of the storage position and letting them hang down as shown in FIG. 5. One can then simply twirl the stand as shown in FIG. 5 using the main post 33 causing the legs to then fly outwardly under centrifugal force at which point the inner end of each leg automatically aligns with its opening 39 with the tension in the stretch cords 45 then pulling the support legs into the openings 39 where they are held in their use position.

In another embodiment of the present invention, the main post 33 is also provided with an internal stretch cord 49. The lower end of this stretch cord is secured at the lower end of housing 47 and the upper end of the stretch cord is attached at the upper end of the post 51 as seen in FIG. 6 of the drawings.

The telescopic sections 35 of the main post 33 are extended outwardly against the tension of stretch cord 49 and locked in the extended position by means of a hand adjustable locking member 53. When locking member 53 is released the tension in stretch cord 49 pulls the telescopic sections back to their storage position shown in FIG. 3 of the drawings.

It will now be seen how an entire combination rack and stand can easily be moved between a use and a storage condition with minimal assembly and disassembly of components within the combination. Furthermore, the rack can be used with essentially any pole like stand and the stand can be used independently of the rack for various different purposes.

Although various different preferred embodiments of the invention have been described in detail, it will be appreciated by those skilled in the art, that variations may be made without departing from the spirit of the invention or the scope of the appended claims.

The embodiments of the invention in which an exclusive property or privilege is claimed are defined as follows:

1. A combination rack and stand, said rack having a book-like construction comprising a pair of side members foldably secured to a spine, said spine having a hollow interior accessible through one end of said spine, a connector arm pivotally secured to said rack beneath said spine, said stand being releasably connected to said arm, said stand being convertible between an extended use and a collapsed storage position such that said stand, when released from said connector and in the collapsed storage position is insertable in said spine through said one end thereof.

2. The combination of claim 1, wherein said rack has a recess beneath said spine, said connector arm comprising a yoke attached to opposite sides of the recess and when disconnected from said stand being pivotal to a storage position hidden in said recess.

3. The combination of claim 2, including an adjustment knob on an outside surface of said spine which loosens and tightens pivotal movement of said yoke within said recess of said pine.

4. The combination of claim 1, including a hollow collar connecting said connector arm to said stand.

5. The combination of claim 4, wherein said hollow collar is part of said connector arm.

6. The combination of claim 1, wherein said stand comprises a main telescopic post and a plurality of support legs all of which are secured to a common housing, said legs being attached to said housing by stretch cord connectors such that said legs fold side by side with said main post in the storage position, said housing being provided with locking means for holding said legs in the storage position and said stretch cords pulling said legs into said locking means when said legs are in the storage position.

7. The combination of claim 6, wherein said locking means comprises leg receiving recess on said housing.

8. The combination of claim 6, wherein said main post telescopes between the use and the storage position and is provided with an internal stretch cord which biases said main post to the storage position, said main post being provided with locking means which releasably locks said main post in the use position against the bias of said stretch cord in said main post.

* * * * *